US008146566B2

(12) United States Patent
Lee et al.

(10) Patent No.: US 8,146,566 B2
(45) Date of Patent: Apr. 3, 2012

(54) COMPRESSION RELEASE ENGINE BRAKE UNIT

(75) Inventors: Gi Ra Lee, Hwaseong-si (KR); Jung Ho Kim, Yongin-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 219 days.

(21) Appl. No.: 12/619,505

(22) Filed: Nov. 16, 2009

(65) Prior Publication Data

US 2010/0307451 A1 Dec. 9, 2010

(51) Int. Cl.
*F02D 13/04* (2006.01)
*F01L 1/245* (2006.01)

(52) U.S. Cl. ..... 123/321; 123/90.12; 123/90.46

(58) Field of Classification Search ..... 123/321, 123/90.12, 90.15, 90.33, 90.39, 90.4, 90.43, 123/90.45, 90.46, 90.55, 90.63
See application file for complete search history.

(56) References Cited

U.S. PATENT DOCUMENTS

| | | | | |
|---|---|---|---|---|
| 3,140,698 | A * | 7/1964 | Voorhies | 123/90.46 |
| 6,386,160 | B1 * | 5/2002 | Meneely et al. | 123/90.16 |
| 6,718,940 | B2 * | 4/2004 | Usko | 123/322 |
| 7,520,262 | B2 * | 4/2009 | Jeong et al. | 123/321 |
| 7,673,600 | B2 * | 3/2010 | Yang | 123/90.16 |
| 7,712,449 | B1 * | 5/2010 | Schwoerer | 123/321 |
| 7,905,208 | B2 * | 3/2011 | Ruggiero et al. | 123/90.22 |
| 7,909,015 | B2 * | 3/2011 | Yang | 123/321 |
| 8,065,987 | B2 * | 11/2011 | Yang | 123/321 |
| 2009/0288626 | A1 * | 11/2009 | Langewisch | 123/90.46 |
| 2011/0023821 | A1 * | 2/2011 | Yoon et al. | 123/321 |
| 2011/0067673 | A1 * | 3/2011 | Yoon et al. | 123/321 |
| 2011/0073068 | A1 * | 3/2011 | Yoon et al. | 123/321 |
| 2011/0079195 | A1 * | 4/2011 | Dilly | 123/321 |
| 2011/0079196 | A1 * | 4/2011 | Kraft et al. | 123/321 |

FOREIGN PATENT DOCUMENTS

| | | | |
|---|---|---|---|
| JP | 6-81620 | A | 3/1994 |
| JP | 8-338215 | A | 12/1996 |
| JP | 2004-132258 | A | 4/2004 |
| KR | 1998-059364 | A | 10/1998 |
| KR | 10-2007-0060403 | A | 6/2007 |

* cited by examiner

*Primary Examiner* — Hai Huynh
(74) *Attorney, Agent, or Firm* — Morgan, Lewis & Bockius LLP

(57) ABSTRACT

A compression release engine brake unit includes an oil outlet passage formed in a socket brake, which stores engine brake oil, and a reset member opening or closing the outlet passage. The reset member discharges the engine brake oil by opening the oil outlet passage in response to the rotation of a rocker arm during engine braking and, thereby, the engine brake restores the initial state. Since the compression release engine brake can restore the initial state, the return valve lift is the same as when the compression release engine brake is not actuated. Accordingly, the valve does not butt against an engine piston.

6 Claims, 6 Drawing Sheets

COMPRESSION RELEASE ENGINE BRAKE UNIT

CROSS REFERENCE TO RELATED APPLICATION

The present application claims priority to Korean Patent Application Number 10-2009-0050815 filed on Jun. 9, 2009, the entire contents of which application is incorporated herein for all purposes by this reference.

BACKGROUND OF THE INVENTION

1. Field of the Invention

The present invention relates to a compression release engine brake unit and, more particularly, to a compression release engine brake unit, which includes an oil outlet passage formed in a socket brake, which stores engine brake oil, and a reset member opening/closing the outlet passage, such that the reset member discharges the engine brake oil by opening the oil outlet passage in response to the rotation of a rocker arm during engine braking and, thereby, the engine brake restores the initial state.

2. Description of Related Art

Engine braking generally refers to the act of slowing down a vehicle by down-shifting to a lower transmission gear. In the engine braking, however, an excessive amount of load is applied to respective parts of an engine since a transmission is down-shifted. This may cause drawbacks such as reduced engine lifetime.

A compression release engine brake was introduced in order to solve the foregoing problem. The compression release engine brake forcibly opens an exhaust valve at the end of compression stroke in order to avoid power stroke and to thereby maximize the effect of engine braking.

FIG. 1 is a graph illustrating a change in the amount of valve lift when a conventional compression release engine brake is actuated.

In a conventional compression release engine brake unit, when the engine brake is actuated, engine brake oil is fed into a socket brake so that a piston moves up and down under the pressure of the engine brake oil. Then, a gap between a valve and a rocker arm can be maintained zero (0), and the exhaust valve can be forcibly opened at the end of compression stroke.

The socket brake allows opening the exhaust valve at the end of compression stroke to slow down a vehicle, thereby maximizing the effect of engine braking. However, as shown in FIG. 1, the engine brake oil is not discharged from the socket brake once introduced to the latter. This causes a problem in that the oil pressure formed inside the socket brake may open the exhaust valve more, thereby bringing the valve into contact with the piston and weakening the performance of the engine brake.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention provide a compression release engine brake unit having an oil outlet passage and a reset member opening/closing the oil outlet passage in order to discharge engine brake from inside a socket brake.

In an aspect of the present invention, the compression release engine brake unit may include a rocker arm pivoting around a rocker arm shaft, a valve bridge connecting a pair of exhaust valves with each other, wherein the valve bridge is pressed by rotation of the rocker arm so that the exhaust valves open or close exhaust ports of a cylinder, and a socket brake placed between a lower portion of an adjustment bolt adjustably coupled with the rocker arm and an upper portion of the valve bridge, wherein the adjustment bolt includes an oil passage fluidly connected to an oil passage formed in the rocker arm, and wherein the socket brake includes, a piston moving away from the rocker arm and pressing the valve bridge in response to introduction of engine brake oil into the oil passage of the adjustment bolt, and a housing having an inner space and slidably receiving the piston therein.

The socket brake may be pivotally connected to the lower portion of the adjustment bolt by a coupling member, wherein the coupling member includes a clip connecting an upper portion of the socket brake to a coupling groove formed at the lower portion of the adjustment bolt.

The socket brake may include an inlet port formed in the housing and selectively connected to the oil passage of the adjustment bolt to receive the engine brake oil therethrough, a storage formed in the piston and fluid-communicating with the inlet port, and an outlet passage formed in the housing and selectively fluid-communicating with the storage of the piston to discharge the engine brake oil introduced in the storage, wherein the engine brake unit further including a reset member selectively opening or closing the outlet passage of the socket brake.

The socket brake further may include a plunger disposed between the inlet port and the storage to selectively open the inlet port in response to the introduction of the engine brake oil, and a first elastic member located between a bottom surface of the storage of the piston and the plunger in the storage to elastically support the plunger towards the inlet port, wherein the storage of the piston stores part of the engine brake oil introduced into the housing, and the piston moves away from the rocker arm inside the inner space of the housing in response to the introduction of the engine brake oil into the storage while a pressure of the engine brake oil overcomes an elastic force of the first elastic member.

The housing of the socket brake may include a reset bar chamber extending across the outlet passage, and the reset member may include a reset bar fitted into the reset bar chamber to move along the reset bar chamber, thereby opening or closing the outlet passage, a push plate coupled with the rocker arm to selectively push the reset bar according to the rotation of the rocker arm, and a second elastic member located under the reset bar to apply an elastic force to the reset bar in a direction closing the outlet passage.

The reset bar may include a flange protruding outwards from an outer circumference of a lower portion thereof, with a diameter of the flange being approximately the same as an inner diameter of the reset bar chamber, and the reset bar chamber may include a rib protruding towards a central axis from an inner circumference of an upper portion thereof, such that the reset bar does not completely come off from the reset bar chamber when the reset bar is elastically supported by the second elastic member of the reset member in a direction closing the outlet passage.

An underside of the push plate may be distanced at a predetermined interval from an upper surface of the reset bar when the rocker arm does not rotate.

The push plate may come into contact with the reset bar before a maximum lift of the exhaust valve caused by the rotation of the rocker arm and allows the reset bar to completely open the outlet passage at the maximum lift, thereby discharging the engine brake oil from inside the socket brake.

According various aspects of the present invention, the compression release engine brake can restore the initial state by discharging engine brake oil using the compression release engine brake unit. Thus, the return valve lift is the same as when the compression release engine brake is not actuated. Accordingly, the valve does not butt against an engine piston.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
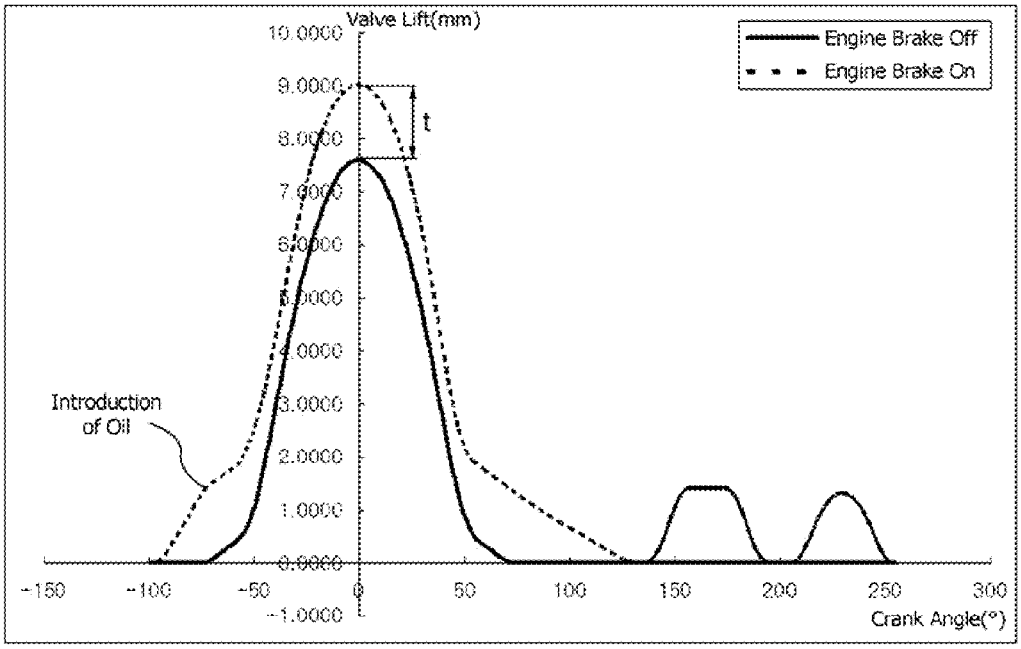
FIG.1 (Prior Art)
FIG. 1 is a graph illustrating a change in the amount of valve lift when a conventional compression release engine brake is actuated.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 2:
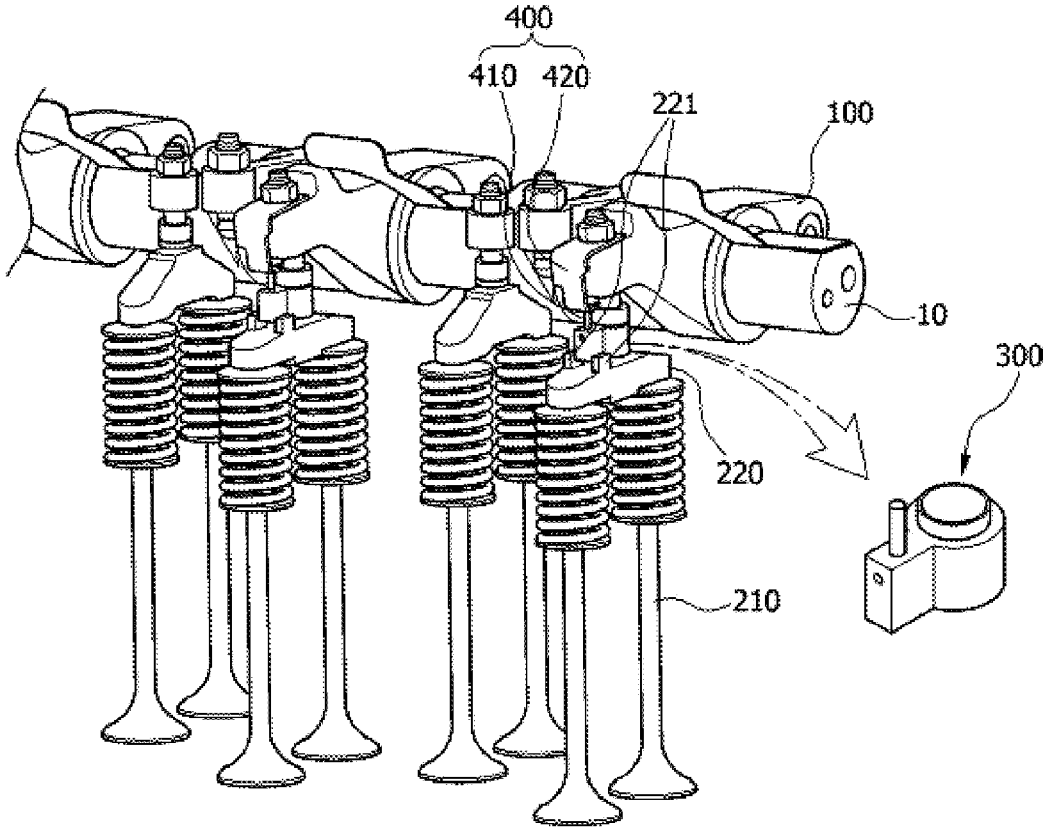
FIG. 2 is a perspective view illustrating compression release engine brake units in accordance with an exemplary embodiment of the present invention.
Figure 3A:
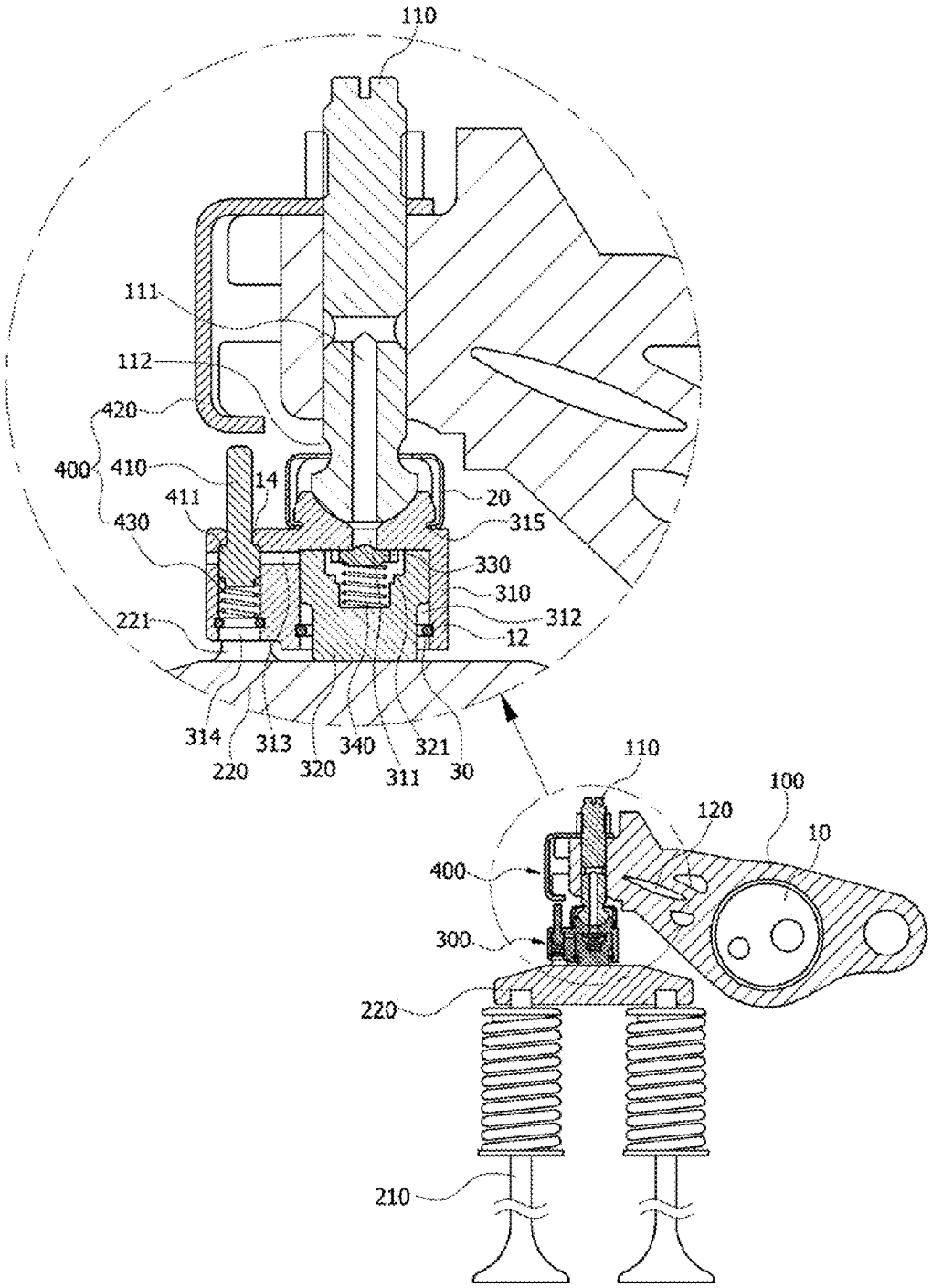
FIGS. 3A and 3B are cross-sectional views illustrating operational stages of a compression release engine brake unit in accordance with an exemplary embodiment of the present invention.
Figure 3B:
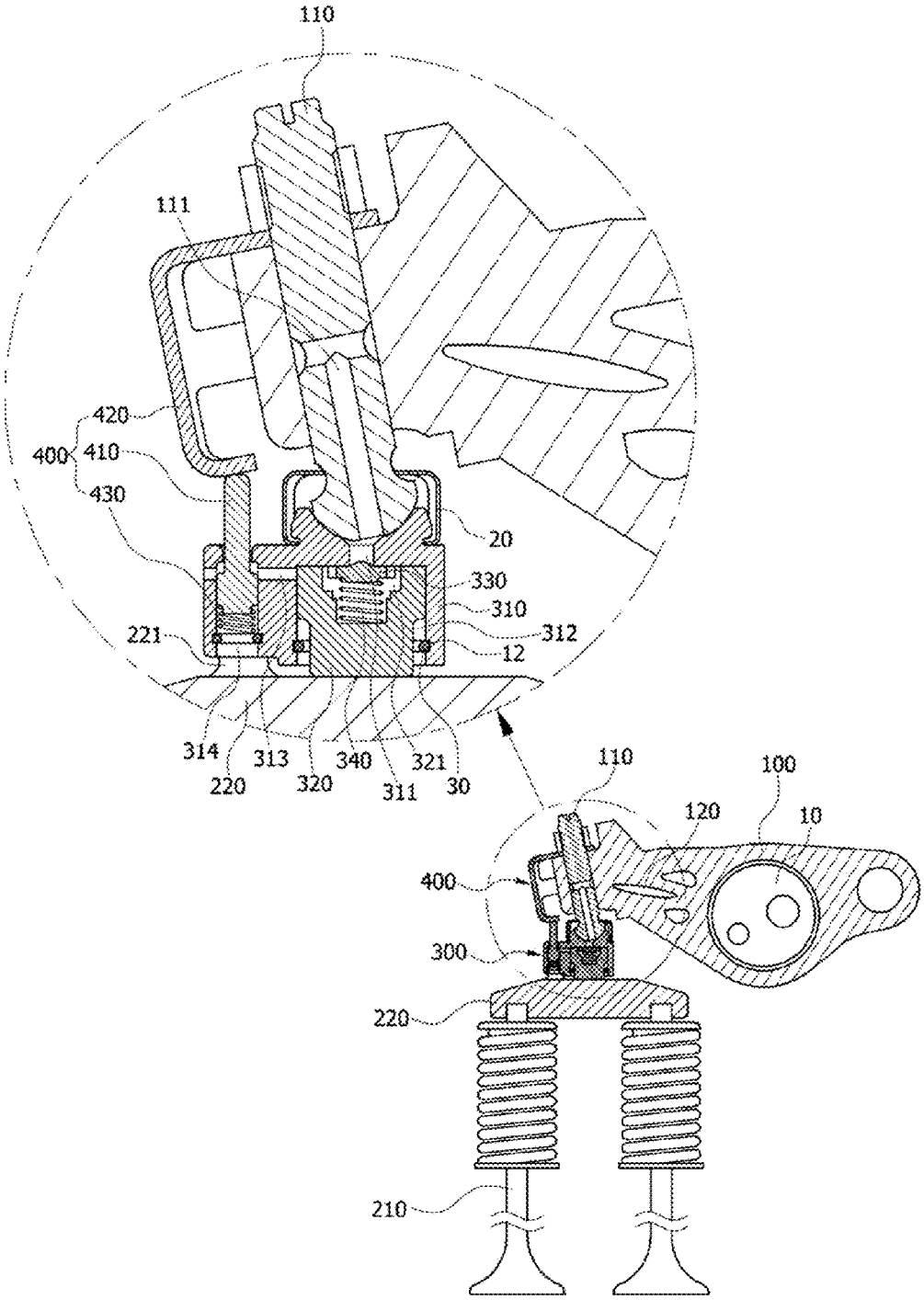

FIG. 2 is a perspective view illustrating compression release engine brake units in accordance with an exemplary embodiment of the present invention, and FIGS. 3A and 3B are cross-sectional views illustrating operational stages of one compression release engine brake unit in accordance with an exemplary embodiment of the present invention.

The compression release engine brake unit of the present invention includes a rocker arm 100, a valve bridge 220, a socket brake 300, and a reset member 400. The rocker arm 100 is mounted around a rocker arm shaft 10 and is caused to pivot by a cam (not shown). The valve bridge 220 connects a pair of exhaust valves 210 with each other and is pushed by the rotation of the rocker arm 100 so that the exhaust valves 210 open and close exhaust ports of a cylinder (not shown). The socket brake 300 includes a piston 320 placed between an adjustment bolt 110 coupled to the rocker arm 100 and the valve bridge 220. The piston 320 is configured to move up and down in response to the introduction of engine brake oil. The reset member 400 opens and closes an outlet passage 313 in the socket brake 300 in order to discharge the engine brake oil.

Although not illustrated in the figures, a flange is formed along the outer circumference of the cam such that the rocker arm can open the exhaust valves at the end of compression stroke. The flange makes it possible to set an optimum time and amount of opening of the exhaust valves.

In the case of compression release engine braking, when the engine brake oil is introduced into the socket brake 300 placed between the rocker arm 100 and the valve bridge 220, the piston 320 moves up and down so that a valve gap can be maintained substantially zero (0). As a result, the exhaust valve 210 can be forcibly opened at the end of compression stroke.

Since the compression release engine brake unit of the present invention includes the outlet passage 313 discharging the engine brake oil from the socket brake 300 and the reset member 400 opening/closing the outlet passage 313, the brake oil can be discharged from the socket brake 300 so that the socket brake 300 can return to the initial state before the oil is introduced.

The socket brake 300 operating in response to the introduction of the engine brake oil includes a housing 310, a piston 320, a plunger 330, and an elastic member 340.

The housing 310 has an inner space 312, an inlet port 311, and the outlet passage 313 for discharging the introduced engine brake oil. A hemispherical socket, into which the lower portion of the adjustment bolt 110 can fit, is formed in the upper portion of the housing 310 above the inlet port 311.

The housing 310 is coupled with the adjustment bolt 110 by a separate clip 20. The clip 20 is shaped like a hollow cylinder with upper and lower openings, and has upper and lower ribs protruding towards the central axis from around the upper and lower openings. The upper rib of the clip 20 is fitted into a coupling groove 112 formed around the lower portion of the adjustment bolt 110, and the lower rib of the clip 20 is fitted into a coupling groove 315 formed around the upper portion of the housing 310. In this fashion, the clip 20 couples the housing 310 with the adjustment bolt 110. In this configuration, the coupling groove 112 of the adjustment bolt 110 can be formed with a predetermined curvature to prevent the clip 20 from being unfastened from the coupling groove 112 even if the adjustment bolt 110 is slanted by the pivoting of the rocker arm 100.

In addition, the valve bridge 220 has fitting protrusions 221 protruding from the upper portion thereof facing the housing 310. Specifically, the fitting protrusions 221 are formed on two upper positions adjacent to longer edges of the valve bridge 220 and are arrayed in the width direction of the valve bridge 220. The fitting protrusions 221 can prevent the housing 310 from rotating around the central axis of the inner space 312.

The piston 320 is placed inside the inner space 312 of the housing 310, and has an oil chamber 321 storing the introduced engine brake oil. The piston 320 moves up and down inside the inner space 312 of the housing 300 in response to the introduction of the engine brake oil. The underside of the piston 320 can be configured to maintain constant contact with the upper surface of the valve bridge 220.

A groove 12 is formed along the inner circumference of the lower portion of the housing 310, and a snap ring 30 is snapped into the groove 12 to thereby hold the piston 320 inside the inner space 310 of the socket brake 300.

The plunger 330 moves up and down inside the inner space 312 in response to the introduction of the engine brake oil, thereby opening and closing the inlet port 311. The elastic member 340 is located between the bottom surface of the storage 321 and the underside of the plunger 330 to elastically support the plunger 330 towards the inlet port 311.

With this configuration, the engine brake oil is fed into the socket brake 300 through an oil passage 120 inside the rocker arm 100, through an oil passage 111 inside the adjustment bolt 110 coupled with the rocker arm 100, and then through the inlet port 311.

The outlet passage 313 is opened and closed by the reset member 400 to discharge the engine brake oil from inside the socket brake 300. The reset member 400 includes a reset bar 410, a push plate 420, and an elastic member 430.

The reset bar 410 opening and closing the outlet passage 313 is fitted into a reset bar chamber 314, which is formed in the housing 310 of the socket brake 300 to extend across the outlet passage 313. The elastic member 430 is disposed under the reset bar 410 to apply an elastic force to the reset bar 410 in the direction closing the outlet passage 313. The elastic member 430 is supported by a snap ring fitted into a groove that is formed in the lower portion of the reset bar chamber 314.

The reset bar 410 has a flange 411 protruding from the outer circumference of the lower portion thereof, with the same diameter as the inner diameter of the reset bar chamber 314, and the reset bar chamber 314 has an inwardly-protruding rib 14 in the upper portion thereof, with the same diameter as the reset bar 410 excluding the flange 411, so that the reset bar 410 does not completely come off from the reset bar chamber 314 under the elastic force of the elastic member 430 of the reset member 400.

With this configuration, the flange 411 does not completely come off from the reset bar chamber 314 since it is caught by the rib 14 in the upper portion of the reset bar chamber 314.

The push plate 420 is made of a curved plate and is fixedly coupled to the rocker arm 100. The push plate 420 pushes the reset bar 410 in the direction of the elastic member 430 so that the reset bar 410 compresses the elastic member 430. The push plate 420 is screwed into the rocker arm 100 in order to facilitate assembling to and disassembling from the rocker arm 100. Since the push plate 420 is embodied by bending a predetermined length of plate, it is possible to simply fabricate the push plate 420 with a minimum weight.

In the parking position in which the rocker arm 100 does not rotate, the underside of the push plate 420 is distanced from the upper surface of the reset bar 410 with a predetermined gap. At the time point when the exhaust valve 210 is the lifted to the maximum extent in response to the rotation of the rocker arm 100 driven by the cam (not shown), the push plate 420 pushes the reset bar 410.

Specifically, the push plate 420 comes into contact with the reset bar 410 just before the maximum lift of the exhaust valve 210 caused by the rotation of the rocker arm 100 and allows the reset bar 410 to completely open the outlet passage 313 at the time of the maximum lift, thereby discharging all the engine brake oil from inside the socket brake 300.

Figure 4:
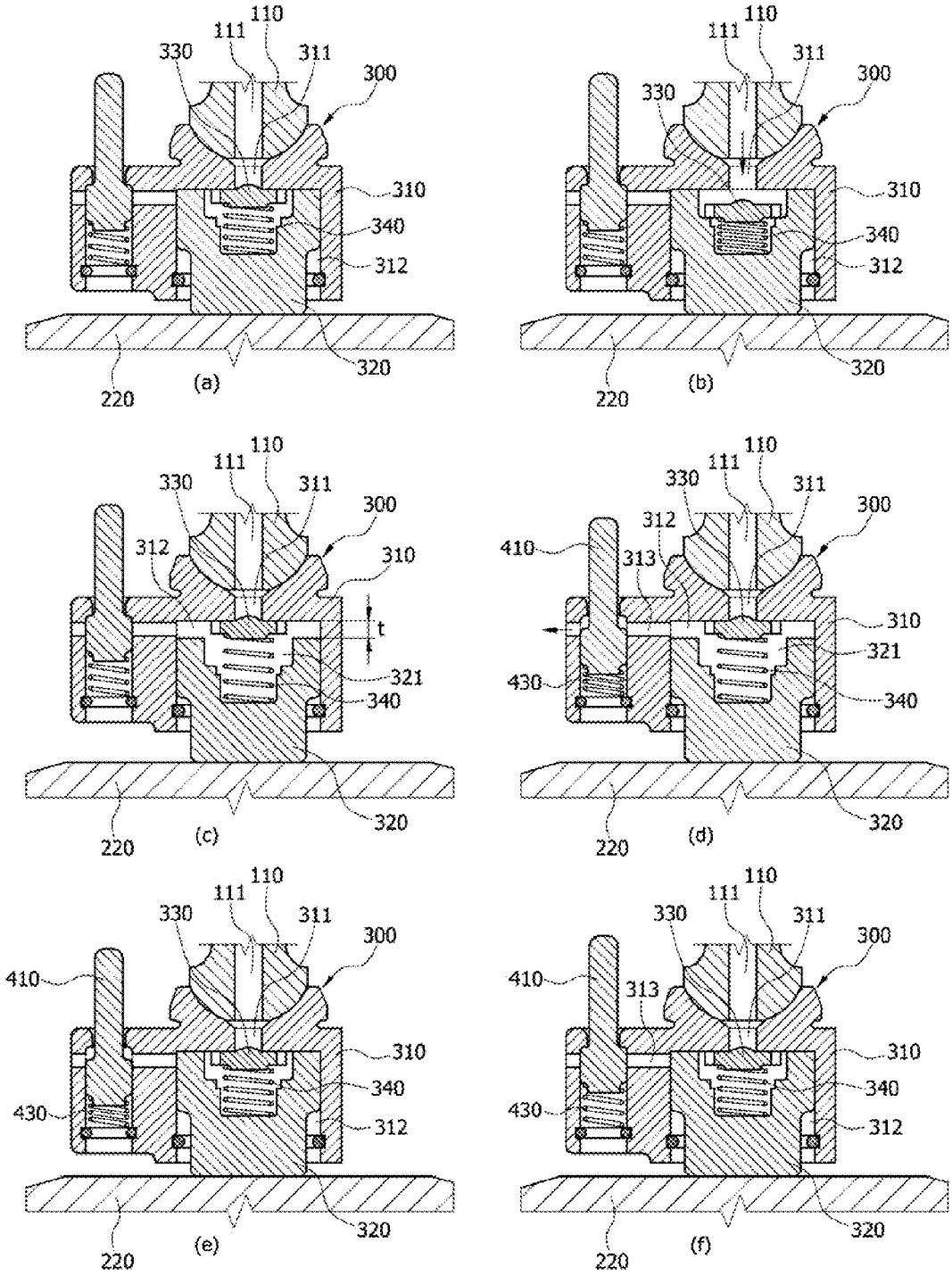
FIG. 4 is cross-sectional views illustrating operational stages of the socket brake of the compression release engine brake unit in accordance with an exemplary embodiment of the present invention.
Figure 5:
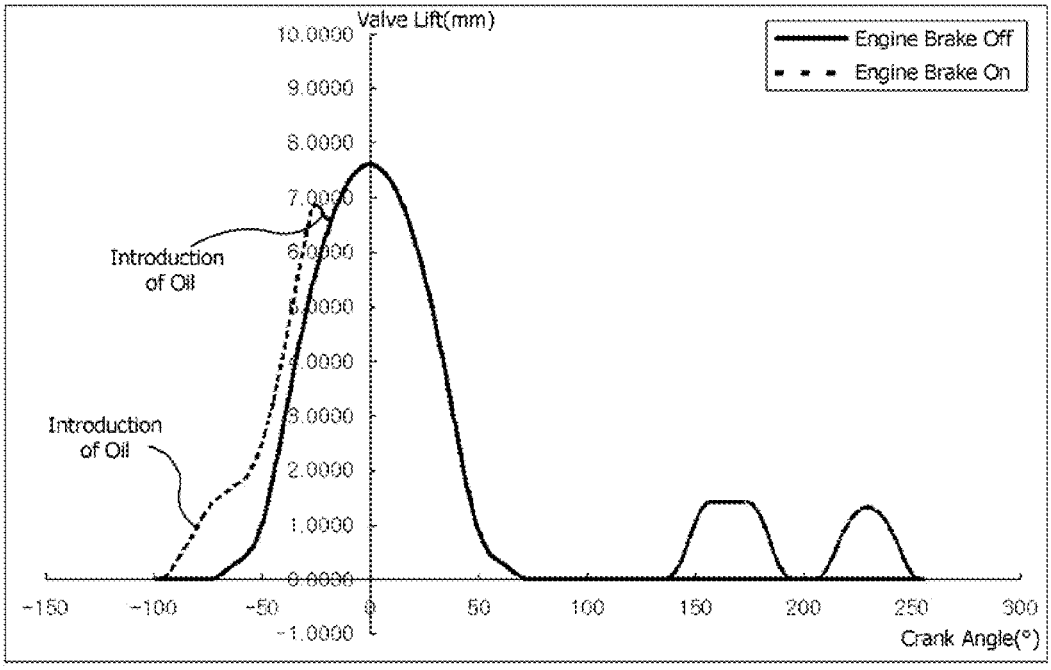
FIG. 5 is a graph illustrating a change in the amount of valve lift when a compression release engine brake in accordance with an exemplary embodiment of the present invention is actuated.

FIG. 4 is cross-sectional views illustrating operational stages of the socket brake of the compression release engine brake unit in accordance with an exemplary embodiment of the present invention, and FIG. 5 is a graph illustrating a change in the amount of valve lift when a compression release engine brake in accordance with an exemplary embodiment of the present invention is actuated.

A description is given of the operational stages of the socket brake 300 with reference to FIG. 4 (*a*) through (*f*) together with FIGS. 3A and 3B above. As shown in FIG. 4 (*a*), when the compression release engine brake is not actuated, engine brake oil is not fed. The upper surface of the piston 320 is butted against the ceiling of the inner space 312 of the housing 310, and the inlet port 311 is closed by the plunger 320.

In FIG. 4 (*b*), as the compression release engine brake is actuated, the engine brake oil is fed into the housing 310 of the socket brake 300 through the oil passage 111 of the adjustment bolt 110. The elastic member 340 of the socket brake 300 is compressed by the introduction of the engine brake oil, and the plunger 330 opens the inlet port 311.

As shown in FIG. 4 (*c*), the engine brake oil is introduced into the storage 321 of the piston 320 in response to opening of the inlet port 311, and the elastic member 340 returns to the uncompressed position so that the plunger 330 closes the inlet port 311. At the same time, the introduced engine brake oil generates an oil pressure inside the inner space 312 of the housing 310 so that the piston 320 moves towards the valve bridge 220 (i.e., downwards in FIG. 4) as far as a valve gap t.

In FIG. 4 (*d*), in the state where the engine brake oil is stored in the inner space 312 of the socket brake 310, the push plate 420 pushes the reset bar 410 towards the elastic member 430 of the reset member 400, thereby compressing the elastic member 430. The compressed elastic member 430 allows the reset bar 410 to open the outlet passage 313. When the outlet passage 313 is opened, the engine brake oil is discharged from the inner space 312 and the storage 321. As shown in FIG. 4 (*e*), when the oil pressure inside the housing 310 is removed, the piston 320 moves towards the adjustment bolt 110 (i.e., upwards in FIG. 4).

All the engine brake oil is instantaneously discharged from inside the housing 310 in the state where the reset bar 410 is pushed. As shown in FIG. 4 (*f*), as the external force of the push plate 420 is removed, the reset bar 410 closes the outlet passage 313 under the restoring force of the elastic member 430.

Below, a description will be given of a change in the amount of valve lift. When the compression release engine brake is actuated, the valve lift proceeds in response to the engine brake oil introduced into the socket brake from the time point where compression stroke begins. The engine brake oil is discharged at a time point near the end of the compression stroke, that is, just before the piston inside the cylinder reaches the upper dead point. As a result, a predetermined gap is formed to thereby represent the same valve lift as before the actuation of the engine brake.

Since the engine brake oil can be discharged from inside the socket brake, the compression release engine brake can constantly restore the initial state. This as a result can prevent the valve gap from being maintained zero (0) by the remaining engine brake oil. Otherwise, the maximum valve lift may exceed a normal range and, thereby, cause the valve and the piston to contact each other which can be dangerous.

For convenience in explanation and accurate definition in the appended claims, the terms "upper", "lower", and "inner"

are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A compression release engine brake unit comprising:

a rocker arm pivoting around a rocker arm shaft;

a valve bridge connecting a pair of exhaust valves with each other, wherein the valve bridge is pressed by rotation of the rocker arm so that the exhaust valves open or close exhaust ports of a cylinder; and a socket brake placed between a lower portion of an adjustment bolt adjustably coupled with the rocker arm and an upper portion of the valve bridge, wherein the adjustment bolt includes an oil passage fluidly connected to an oil passage formed in the rocker arm, and wherein the socket brake comprises:

a piston moving away from the rocker arm and pressing the valve bridge in response to introduction of engine brake oil into the oil passage of the adjustment bolt; and a housing having an inner space and slidably receiving the piston therein;

wherein the socket brake has:

an inlet port formed in the housing and selectively connected to the oil passage of the adjustment bolt to receive the engine brake oil therethrough;

a storage formed in the piston and fluid-communicating with the inlet port; and an outlet passage formed in the housing and selectively fluid-communicating with the storage of the piston to discharge the engine brake oil introduced in the storage;

wherein the engine brake unit further comprising a reset member selectively opening or closing the outlet passage of the socket brake;

wherein the socket brake further comprises:

a plunger disposed between the inlet port and the storage to selectively open the inlet port in response to the introduction of the engine brake oil; and a first elastic member located between a bottom surface of the storage of the piston and the plunger in the storage to elastically support the plunger towards the inlet port, wherein the storage of the piston stores part of the engine brake oil introduced into the housing, and the piston moves away from the rocker arm inside the inner space of the housing in response to the introduction of the engine brake oil into the storage while a pressure of the engine brake oil overcomes an elastic force of the first elastic member;

wherein the housing of the socket brake includes a reset bar chamber extending across the outlet passage; and wherein the reset member comprises:

a reset bar fitted into the reset bar chamber to move along the reset bar chamber, thereby opening or closing the outlet passage;

a push plate coupled with the rocker arm to selectively push the reset bar according to the rotation of the rocker arm; and a second elastic member located under the reset bar to apply an elastic force to the reset bar in a direction closing the outlet passage.

2. The engine brake unit in accordance with claim 1, wherein the socket brake is pivotally connected to the lower portion of the adjustment bolt by a coupling member.

3. The engine brake unit in accordance with claim 2, wherein the coupling member includes a clip connecting an upper portion of the socket brake to a coupling groove formed at the lower portion of the adjustment bolt.

4. The engine brake unit in accordance with claim 1, wherein the reset bar has a flange protruding outwards from an outer circumference of a lower portion thereof, with a diameter of the flange being approximately the same as an inner diameter of the reset bar chamber, and the reset bar chamber has a rib protruding towards a central axis from an inner circumference of an upper portion thereof, such that the reset bar does not completely come off from the reset bar chamber when the reset bar is elastically supported by the second elastic member of the reset member in a direction closing the outlet passage.

5. The engine brake unit in accordance with claim 1, wherein an underside of the push plate is distanced at a predetermined interval from an upper surface of the reset bar when the rocker arm does not rotate.

6. The engine brake unit in accordance with claim 1, wherein the push plate comes into contact with the reset bar before a maximum lift of the exhaust valve caused by the rotation of the rocker arm and allows the reset bar to completely open the outlet passage at the maximum lift, thereby discharging the engine brake oil from inside the socket brake.

* * * * *